US008435715B2

(12) United States Patent
Nakamura et al.

(10) Patent No.: US 8,435,715 B2
(45) Date of Patent: May 7, 2013

(54) PRODUCTION METHOD OF TWO-COMPONENT DEVELOPER

(75) Inventors: Kosuke Nakamura, Tokyo (JP); Hiroyuki Kozuru, Yamanashi (JP); Yoshiyasu Matsumoto, Tokyo (JP); Takanari Kayamori, Kanagawa (JP); Junya Ueda, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 9 days.

(21) Appl. No.: 13/185,123

(22) Filed: Jul. 18, 2011

(65) Prior Publication Data

US 2012/0028186 A1 Feb. 2, 2012

(30) Foreign Application Priority Data

Jul. 30, 2010 (JP) ..... 2010-171435

(51) Int. Cl.
*G03G 5/00* (2006.01)

(52) U.S. Cl.
USPC ..... 430/137.13; 430/110.2

(58) Field of Classification Search ..... 430/110.2, 430/137.11, 137.13
See application file for complete search history.

(56) References Cited

U.S. PATENT DOCUMENTS

| | | | | |
|---|---|---|---|---|
| 2010/0119967 | A1* | 5/2010 | Inoue et al. | 430/110.3 |
| 2010/0183971 | A1* | 7/2010 | Fujikawa et al. | 430/110.3 |

FOREIGN PATENT DOCUMENTS

| | | |
|---|---|---|
| JP | 08-248684 | 9/1996 |
| JP | 2702195 | 10/1997 |
| JP | 2003-156887 | 5/2003 |
| JP | 2008-224882 | 9/2008 |
| JP | 2009-025600 | 2/2009 |

* cited by examiner

*Primary Examiner* — Stewart Fraser
(74) *Attorney, Agent, or Firm* — Lucas & Mercanti, LLP

(57) ABSTRACT

Disclosed is a production method of a two-component developer for developing an electrostatic image comprising a toner and a resin coated carrier having a porous magnetic core particle and a resin coated layer, wherein the porous magnetic core particle are composed of a porous ferrite material and have pore apertures on a surface of the particle, and the method comprises steps of blocking the pore apertures of the porous magnetic core particle with rubber particles by dry mixing of the porous magnetic core particle and the rubber particles, forming the resin coated carrier by forming a resin layer on the porous magnetic core particle whose pore apertures have been blocked, and mixing the resin coated carrier and the toner.

10 Claims, 2 Drawing Sheets

PRODUCTION METHOD OF TWO-COMPONENT DEVELOPER

CROSS REFERENCE TO RELATED APPLICATION

This Application claims the benefit of priority of Japanese Patent Application No. 2010-171435 filed Jul. 30, 2010, and is incorporated herein by reference.

TECHNICAL FIELD

The present invention relates to a production method of a two-component developer used in electrophotographic image formation, and more specifically, to a production method of a two-component developer having a resin coated carrier in which a magnetic core particle whose fine hole openings (pore apertures) of the surface have been capped with a rubber particle is coated with a resin.

BACKGROUND

Developers used for electrophotographic image forming apparatuses such as copiers and printers include single-component developers incorporating only a toner and two-component developers incorporating a magnetic powder referred to as a carrier and a toner. Image formation using a two-component developer is an advantageous system to carry out high-speed print production, since, due to the presence of a carrier, rapid toner charging can be carried out.

A carrier used in a two-component developer charges a toner as described above, and needs to have stable charge providing performance over a long term even when repeatedly used for tone charging. Such a carrier is constituted of a magnetic particle referred to as a core material (core), and its form includes one in which a core material is used as a carrier as is, as well as another one referred to as a resin coated carrier structured by coating the core material surface with a thermoplastic resin.

Such a resin coated carrier has a structure in which the core particle surface is coated with a resin and thereby has excellent durability and stable friction chargeability. Further, a technology, in which a resin is coated with no organic solvent, has been established (for example, refer to Patent Document 1). The production method of Patent Document 1 realizes uniform and tight bonding of a resin particle to the core particle surface using a stirring action via rotation of a rotary vane and thereby can provide a resin coated carrier having a uniform, adequately thick resin layer and exhibiting excellent durability and stable friction charge providing performance.

Incidentally, in an electrophotographic image forming apparatus, with an increase in print production speed and size reduction of the apparatus, the stirring action in the developing device has become strong and such vigorous stirring has increased the impact applied to the developer. For example, during stirring, a violent collision between a toner and a carrier has occurred and thereby the collision causes toner particle breakage and external additive burial, whereby the toner has been unable to be charged at a predetermined level. As a result, there have been produced problems such as occurrence of image failure such as fog and transfer failure due to poor charging of the toner, a decrease in charging performance due to adhesion of toner-fractured materials to the carrier particle surface, and occurrence of contamination inside the machine caused by scattered materials. Further, with regard to a resin coated carrier particle having been subjected to a strong impact, a resin layer formed on the surface thereof is peeled of and then the resistance of the carrier is markedly decreased, whereby an adverse effect on charging for the toner has been produced.

For these problems, a technology, in which the weight of a carrier particle is reduced and thereby the impact applied to a developer during stirring is allowed to decrease, has been investigated. For example, a magnetic powder dispersed carrier in which fine magnetic power is dispersed in a resin has been proposed (for example, refer to Patent Document 2). However, in such a magnetic powder dispersed carrier, since a binder resin covers the magnetic powder, carrier resistance increases and thereby the toner is inadequately charged, resulting in the difficulty of formation of a toner image having sufficient image density. Further, in high-speed print production, due to an impact caused by stirring, the resin is peeled off and then the magnetic powder is removed, whereby problems have been produced in stable toner image formation.

Therefor, a technology has been investigated in which using a porous magnetic core particle having fine holes (hereinafter referred to also as pores) on the surface, a resin is filled in the fine holes and also physical properties such as porosity are specified to reduce the weight of a carrier particle (for example, refer to Patent Documents 3 and 4). Further, a carrier has been studied in which a resin is injected into holes and thereby adhesion properties between a porous magnetic core particle and the resin is enhanced to stably carry out large-volume printing at a level of hundreds of thousands of sheets (for example, refer to Patent Document 5).

PRIOR ART DOCUMENTS

Patent Documents

[Patent Document 1] Japanese Patent No. 2702195

[Patent Document 2] Unexamined Japanese Patent Application Publication (hereinafter referred to as JP-A) No. H08-248684

[Patent Document 3] JP-A No. 2003-156887

[Patent Document 4] JP-A No. 2008-224882

[Patent Document 3] JP-A No. 2009-25600

BRIEF DESCRIPTION OF THE INVENTION

Problems to be Solved by the Invention

However, it has been made clear that it is more difficult than expected to reduce the weight of a carrier particle employing a porous magnetic core particle (hereinafter also referred to simply as a magnetic core particle or core particle) as described in the above parent documents. Namely, since a porous magnetic core particle having small specific gravity by the presence of hollow areas is used, it has been thought that the weight of a carrier is easily reduced. However, when high-speed print production was carried out using a produced carrier, image failure and toner particle breakage occurred as before. In addition, carrier weight reduction has not been realized either.

The reason is thought as follows: a larger amount of a resin was filled in holes of a core particle than expected, resulting in an increase in weight. Actually, in a magnetic core particle having larger porosity, the filled amount of a resin was increased. Thereby, in high-speed print production, breakage of toner particles and carrier particles and image failure occurred, and the impact during stirring was increased. Further, filling of a resin in holes increased the added amount of the resin, resulting in a decreased yield of a raw material in production.

Therefore, to produce a resin coated carrier of small specific gravity using a porous magnetic core particle, it has been necessary that a resin is prevented from penetrating holes and while ensuring the hollow state, the core particle surface is coated with the resin with uniform thickness. In the present invention, in order for a resin not to penetrate the interior of fine pores of a porous magnetic core particle, pore apertures are blocked with a solvent resistant resin and then coated with a coating resin for charge providing to produce a resin coated carrier of small specific gravity. Eventually, an object of the present invention is to provide a two-component developer in which the impact applied to a toner during stirring can be reduced.

Namely, a two-component developer is intended to be provided in which even in the case where stirring is vigorously carded out in the developing device as in high-speed print production, the weight of a resin coated carrier is reduced and thereby toner particle breakage and external additive burial or resin layer removal on the carrier surface is not allowed to occur. Specifically, a two-component developer is intended to be provided in which even with the impact due to stirring, a tone particle and a carrier particle are not degraded and thereby stable charging performance is maintained to stably produce printed matter free from image defects such as fog and transfer failure.

Means to Solve the Problems

The present invention and its preferred embodiment will now be described.

A production method of a two-component developer for developing an electrostatic image comprising a toner and a resin coated carrier having a porous magnetic core particle and a resin coated layer, wherein the porous magnetic core particle are composed of a porous ferrite material and have pore apertures on a surface of the particle, wherein the method comprises steps of;

blocking the pore apertures of the porous magnetic core particle with rubber particles by dry mixing of the porous magnetic core particle and the rubber particles, forming the resin coated carrier by forming a resin layer on the porous magnetic core particle whose pore openings have been blocked, and mixing the resin coated carrier and the toner.

The particles of the porous magnetic core particle have preferably a peak of pore diameter distribution of 0.2 μm to 1.8 μm, and the particle diameter of each of rubber particles is preferably 0.3 times to 0.8 times of the pore diameter.

The glass transition temperature of a rubber particle is preferably −85° C. to +35° C., and more preferably −40° C. to +30° C.

The toluene insoluble matter of a rubber particle is preferably 15% by mass to 95% by mass, and more preferably 30% by mass to 70% by mass. In a ferrite core particle, the ratio occupied by space areas formed by pores is preferably 20% to 40%.

In the present invention, when a resin coated carrier is produced using a porous magnetic core particle, a step to fill pore apertures of the magnetic core particle with a first polymer (rubber) particle is provided and thereby when coating by a second polymer (resin) is carried out, resin penetration into the pore interior is prevented, whereby a resin coated carrier of small specific gravity can be produced. Herein, the wording "pore apertures in which a rubber particle is filled" refers to areas ranging from a pore opening portion to a depth of 2 μm in a magnetic core particle.

The present invention provides a lightweight resin coated carrier for a two-component developer, which makes it possible to provide a two-component developer exhibiting durability in which even in the state where a toner and a carrier are strongly stirred in the developing device as in high-speed print production, an impact from a carrier due to stirring is reduced. Namely, toner particle breakage and external additive burial due to the impact caused by stirring are inhibited, and also with respect to a carrier itself, a resin layer is prevented from peeling off from the surface.

Accordingly, a toner and a carrier exhibit enhanced durability, which makes it possible that between both, predetermined charging is stably carried out over a long term and also print production of excellent image quality without the tendency of occurrence of image defects is stably carried out. Further, since predetermined charging is stably carried out over a long term, any toner having insufficient charge amount or any carrier with no charge providing performance due to particle breakage is not generated, which makes it possible that print production free from image failure and contamination inside the machine due to scattering of a degraded developer is carried out.

PREFERRED EMBODIMENT OF THE INVENTION

The present invention relates to a production method of a two-component developer.

In the present invention, using a porous magnetic core particle for carrier production, when the magnetic core particle surface is coated with a resin, a step, in which a first polymer particle (hereinafter referred to also as a rubber particle) is filled in pore apertures of the magnetic core particle surface to produce a carrier intermediate, is provided to form a resin coated layer on a magnetic core particle (carrier intermediate) whose pore apertures have been blocked with a rubber particle, and thereby a step to produce a resin coated carrier is provided. Thereby, the weight reduction of a carrier utilizing core hollow portions can be realized with no coating resin penetration into pores of a porous core particle which has been difficult in the conventional production method of a resin coated carrier.

The present invention will now be detailed.

Figure 1A:
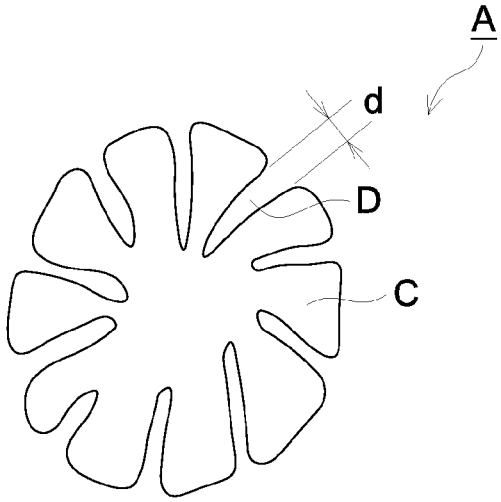
FIG. 1*a* is a schematic view illustrating pores and pore diameter in a porous magnetic core particle.

"A magnetic core particle" used in the present invention has an enormous number of fine hollow holes referred to as "pores" leading to the surface thereof and exhibits small specific gravity due to the presence of hollow portions formed by pores, compared with a common magnetic core particle of the same material and volume. Pores of such a magnetic core particle can be detected by a common measurement member, for example, via observation of a magnetic core particle cross-section using an electron microscope. FIG. 1*a* schematically shows pores and pore diameter in a porous magnetic core particle. In this figure, A and C represent a porous magnetic core particle and a magnetic material typified by ferrite, respectively; and D and d represent a pore and the diameter (pore diameter) of a pore opening D, respectively. In the porous magnetic core particle A of FIG. 1*a*, the pore D and the pore diameter d are emphasized, and thereby compared with an actual porous magnetic core particle, the number of pores is small and these pores are large.

The ratio of hollow portions formed by pores of a magnetic core particle, that is, the ratio occupied by space areas formed by the pores in the magnetic core particle is referred to as "porosity." The porosity of a magnetic core particle is commonly 10% to 60%, preferably 20% to 40%. The porosity referred to in the present invention refers to mercury injection volume employing a mercury porosimeter. The determination method using such a mercury porosimeter will be described later.

The pore diameter and the porosity of a magnetic core particle can be determined by the mercury injection method using a mercury porosimeter. In the mercury injection method, mercury, which is unreactive with most materials and exhibits no leakage, is applied with pressure and then injected in pores of a solid, and thereby the relationship between the pressure applied in this moment and the volume of the injected mercury is measured to calculate pore diameter. Namely, a sample cell in which mercury is filled in a high-pressure container is prepared and then the interior of the container is gradually pressurized, and thereby the mercury is allowed to penetrate in the order from larger pores to small pores. By use of this, from the volume of the injected mercury, pore diameter can be calculated.

The relationship between a pressure applied during injection of mercury and a pore diameter into which the mercury can be penetrated with the pressure is derived by Washburn equation shown as follows:

$$D=-4\gamma\cos\theta/P$$

in the equation, P and D represent an applied pressure and a pore diameter, respectively, and γ and θ represent the surface tension of mercury and the contact angle between the mercury and the pore wall surface, respectively. Herein, since γ and θ are constants, from the equation, the relationship between the applied pressure P and the pore diameter D is determined. The penetrating volume of the mercury at this moment is measured and thereby the relationship between the pore diameter and its volume diameter distribution can be derived.

As a specific determination method of the pore diameter of a magnetic core particle used in the present invention, for example, a method employing commercially available porosimeters Pascal 140 and Pascal 240 (each produced by Thermo Fisher Scientific Inc.) is cited. The determination method using these mercury porosimeters is carried out as follows. Namely, (1) A measurement sample is place in a commercially available gelatin capsule having a plurality of holes opened and the capsule is placed in dilatometer CD3P for powder.

(2) Degassing is carried out using Pascal 140, and thereafter mercury is filled up to carry out measurement in a low pressure region (0 to 400 kPa), which is designated as a first run.

(3) After the first run, degassing and measurement in the low pressure region are carried out, which is designated as a second run.

(4) After the second run, the total mass of the dilatometer, the mercury, the capsule, and the measurement sample is measured.

(5) Subsequently, using Pascal 240, measurement in a high pressure region (0.1 to 200 MPa) is carried out, and then using a mercury injection amount having been obtained via measurement in this high pressure region, the pore volume, pore diameter distribution, and peak pore diameter of a porous magnetic core particle are determined.

(6) Herein, with respect to the pore volume, pore diameter distribution, and peak pore diameter of the magnetic core particle, the surface tension of mercury and the contact angle are calculated to be 480 dyne/cm and 141.3°, respectively, and as described above, the peak pore diameter is designated as the pore diameter of the magnetic core particle.

Figure 1B:
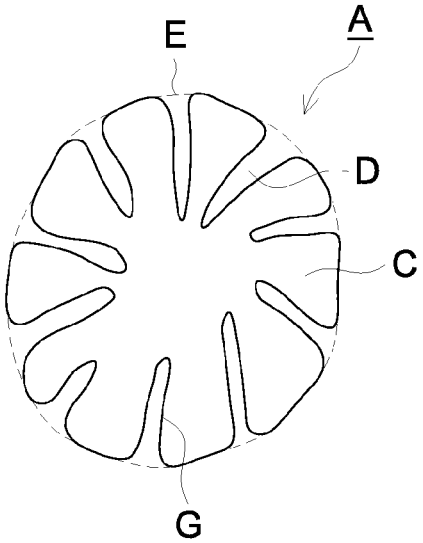
FIG. 1*b* is a schematic view illustrating the calculation procedure of the porosity of a porous magnetic core particle.

Herein, since in the porous magnetic core particle A shown in FIG. 1*b*, the pore D and the pore diameter d are emphasized in the same manner as in the porous magnetic core particle A of FIG. 1*a*, and thereby compared with an actual porous magnetic core particle, the number of pores is small and these pores are extremely large.

The pore size, that is, the pore diameter of a magnetic core particle used in the present invention is preferably 0.2 μm to 1.8 μm. The pore diameter referred to herein is called peak pore diameter. In a porous magnetic core particle, core particle distribution (variation) is shown to some extent. Therefore, the pore diameter having the highest frequency in the distribution is designated as the pore diameter of the porous magnetic core particle. To enhance blocking properties with respect to pore apertures using a rubber particle, variation dv is preferably 0.2 to 1.25.

The variation dv is ded below.

$$dv=|d_{84}-d_{16}|/2$$

Herein, the total mercury injection amount in a high pressure region was designated as 100%. The pore diameter calculated from an applied pressure to mercury when the injection amount thereof reached 84% was designated as $d_{84}$, and the pore diameter calculated from an applied pressure to the mercury when the injection amount thereof reached 16% was designated as $d_{16}$. Further, dv was calculated by expression (1).

The variation of the core diameter can be controlled via adjustment of a raw material used and the pulverization degree of the raw material after tentative firing in real firing.

The pore diameter of a porous magnetic core particle is preferably 0.2 μm to 1.8 μm, since the weight thereof can be adequately reduced by the presence of pores having a diameters of the above range, and then by adding a rubber particle to be described later, a carrier having small specific gravity can be certainly produced. And, in a strep to coat the magnetic core particle surface with a resin, since pore apertures have been filled with a rubber particle, a coating resin solution is prevented from penetrating the pore apertures.

A magnetic core particle used in the present invention is formed of ferrite.

Ferrite is a compound represented by formula $(MO)x(Fe_2O_3)y$, i.e., a compound formed of the portion of a metal oxide represented MO and the portion of ferric oxide. M in the formula represents a metal atom to be described later, and x and y represent the molar ratio of MO and the molar ratio of $Fe_2O_3$.

In the present invention, the molar ratio y of $Fe^2O_3$ constituting ferrite is preferably 30 mole % to 95 mole %. Since with respect to a ferrite particle having a composition ratio y falling in the above range, desired magnetization is easy to realize, an advantage, in which a carrier tending not to cause carrier adhesion is produced, is created.

M in the formula is a metal atom such as manganese (Mn), magnesium (Mg), strontium (Sr), calcium (Ca), titanium (Ti), copper (Cu), zinc (Zn), nickel (Ni), aluminum (Al), silicon (Si), zirconium (Zr), bismuth (Bi), cobalt (Co), or lithium (Li), and these can be used individually or in combination of plural kinds.

Of the ferrites in which a metal atom represented by above M is used, those are preferable in which at least one kind or at least 2 kinds of metal atom selected from manganese (Mn), magnesium (Mg), strontium (Sr), calcium (Ca), titanium (Ti), lithium (Li), aluminum (Al), silicon (Si), zirconium (Zr), and bismuth (Bi) are used, since lightweight ferrite can be produced and in addition, adverse effects on the environmental load are reduced and a resin used in formation of pores is easily injected. Further, those are specifically preferable in which at least one kind or at least 2 kinds of metal atom selected from manganese (Mn), magnesium (Mg), strontium (Sr), calcium (Ca), lithium (Li), zirconium (Zr), and bismuth (Bi) are used.

A magnetic core particle used in the present invention typified by the ferrite core particle can be produced by a common method, for example, via steps described in EXAMPLE to be described later. A typical production method of a magnetic core particle used in the present invention will now be described.

(1) Pulverization Step of Raw Material

This step is one in which an appropriate amount of a raw material of a ferrite core particle is weighed and then placed in a ball mill or vibration mill for dry pulverization treatment. This pulverization treatment is carried out for at least 0.5 hour, preferably for 1 to 20 hours. By controlling the kind of raw materials blended in this step and the degree of pulverization thereof, the porosity, pore diameter, and pore volume of a magnetic core particle can be controlled, as well as apparent density and real density to be described later.

Further, as raw materials to be blended, for example, when a ferrite core particle represented by above formula (MO)x $(Fe_2O_3)$y is produced, a hydroxide compound and a carbonate compound enabling to form a metal oxide in the formula are preferably used. Namely, such a magnetic core particle formed by using a hydroxide compound and a carbonate compound as raw materials are preferable, since porosity and continuous void degree tend to be enhanced, compared with those formed using an oxide compound as a raw material.

(2) Pellet Forming Step

This is a step in which a pulverized material produced by the pulverization treatment is shaped, for example, into a pellet having a size of about 1 square mm using a pressure forming machine. Further, the thus-formed pellet is passed through a sieve of a predetermined mesh opening to eliminate coexisting coarse powder or fine powder.

(3) Tentative Firing Step

This is a step in which a formed pellet is placed in a commercially available electric furnace and heated for several hours. Heating temperature is preferably 700° C. to 1200° C. Further, in this step, heating temperature and heating time are controlled, and thereby the porosity, pore diameter, and pore volume of a magnetic core panicle can be controlled, as well as apparent density and real density to be described later.

Incidentally, a magnetic core particle used in the present invention does not always need to be passed through the tentative firing step, and instead, it is possible that without tentative firing, a pellet is wet-pulverized and then passed through each step such as granulation and firing to be described later to produce a magnetic core particle. In such a magnetic core particle produced with no passing through the tentative firing step, the porosity and continuous void degree of pores tend to increase. From such a point of view, when a porous magnetic core particle is produced, the heating temperature in tentative firing is preferably set lower.

(4) Pulverization Step of Tentatively Fired Material

This is a step in which a pellet (tentatively fired material) having been subjected to the tentative firing treatment is dry-pulverized using a ball mill or vibration mill. Incidentally, in a step to carry out dry pulverization treatment, as described in EXAMPLE to be described later, beads of a particle diameter of at most 1 mm are preferably employed as used media to assuredly carry out uniform and effective dispersion of a raw material and a pellet. Further, the diameter of used beads, the composition, and the pulverization time are controlled, and thereby the degree of pulverization of a raw material and a pellet can be controlled.

(5) Wet Pulverization Step

This is a step in which water is added to a pulverized material produced by the pulverization treatment and pulverized using a wet ball mill or vibration mill to produce a slurry in which a pulverized material having desired particle diameter is dispersed. Herein, in this step, the particle diameter of a pulverized material in the slurry is controlled and thereby the pore diameter of a magnetic core particle can be controlled.

Further, when such slurry is formed, the amount of water added is controlled and thereby the porosity, pore diameter, and pore volume of a magnetic core particle can be controlled, as well as apparent density and real density to be described later. Namely, when the amount of water is increased to form a slurry, a larger number of voids are formed, which is preferable in formation of a magnetic core particle having larger porosity and continuous void degree, as well as smaller apparent density.

(6) Granulation Step

This is a step in which in the slurry produced in the wet pulverization step, dispersion liquid and a binder such as polyvinyl alcohol are added and viscosity is adjusted, followed granulation from the slurry using a spray dryer and then a formed granulated material is dried. The amounts of a binder and water added in the slurry in this step or drying degree is controlled, and thereby the porosity, pore diameter, and pore volume of a magnetic core particle can be controlled, as well as apparent density and real density to be described later.

(7) Real Firing Step

This is a step in which after a granulated material has been dried in the above granulation step, the granulated material is placed in a heating member such as an electric furnace; and as oxygen concentration is controlled via nitrogen gas supply, heating of 1 to 24 hours is carried out at a temperature of 1000° C. to 1500° C. to form a fired material. Herein, in this step, the firing method, heating temperature (firing temperature), heating time (firing time), the supply amount of nitrogen gas, and formation of a reducing ambience using hydrogen gas are controlled, and thereby the porosity, pore diameter, and pore volume of a magnetic core particle can be controlled, as well as apparent density and real density to be described later.

Further, as the heating member used during real firing, an electric furnace, in which firing treatment is carried out in the atmosphere, nitrogen gas ambience, or a reducing ambience by hydrogen gas introduction, is cited. For example, a rotary electric furnace, a batch-type electric furnace, and a tunnel-type electric furnace are included.

(8) Disintegration/Classification Step

This is a step in which a fired material formed in the real firing step is disintegrated and classified to form a ferrite core particle of desired particle diameter. In this step, using wind powered classification, a mesh filtration method, or a precipitation method, the particle size of a formed fired material is adjusted to desired particle diameter.

Further, after carrying out disintegration and classification, as described in EXAMPLE to be described later, a step can be added in which using a magnetic ore separator, those having small magnetic force are separated from a magnetic core particle. Herein, the magnetic ore separator refers to an apparatus in which using a magnet, those having larger magnetic force are separated from a magnetic core particle, including, for example, bar magnets and electromagnetic separators provided as magnetic ore separators produced by Nippon Magnetics Co., Ltd.

Via the above steps, a magnetic core particle used in the present invention can be produced. Formation of a coated film of an oxide (oxide coated film forming treatment) on the magnetic core particle surface by heating can be carried out if appropriate. Such oxide coated film forming treatment can be carried out by heating, for example, using a common electric furnace such as a rotary electric furnace or a batch-type electric furnace at a heating temperature of 300° C. to 700° C. Further, prior to the oxide coated film forming treatment, reduction can be carried out. The thickness of an oxide coated film is preferably 0.1 nm to 5 μm, whereby in a magnetic core particle, appropriate conductivity can be stably maintained; for example, a carrier produced using a magnetic core particle falling in the above range stably expresses excellent charge providing performance for a toner over a long term.

The real density of a magnetic core particle used in the present invention, that is, the density calculated using a volume formed by a magnetic core material except voids of a core particle is preferably 3.0 g/cm$^3$ to 5.5 g/cm$^3$, more preferably 4.0 g/cm$^3$ to 5.5 g/cm$^3$. A porous magnetic core particle whose real density falls in the above range is preferably used since appropriate charging rate can be stably maintained for a long term, and thereby no carrier adhesion due to a decrease in magnetization per particle occurs and the life of a carrier is extended. Incidentally, the real density of a porous magnetic core particle is a value obtained via measurement using a pycnometer based on JIS R9301-2-1.

Further, the apparent density of a magnetic core particle used in the present invention is preferably 0.7 g/cm$^3$ to 2.5 g/cm$^3$, more preferably 0.9 g/cm$^3$ to 2.3 g/cm$^3$. A magnetic core particle preferably has apparent density falling in the above range and exhibits appropriate strength, whereby in a carrier formed using such a magnetic core particle, no breakage of carrier particles occurs even when applied with an impact resulting from stirring in the developing device, resulting in weight reduction and life extension. Herein, the apparent density refers to a density calculated using the sum of a volume formed by a core material and the volume of voids called closed pores existing in the interior of a core particle. Further, the apparent density of a magnetic core particle refers to a value determined based on JIS-Z2504 which is an apparent density testing method for metal powder.

The volume based median diameter (D50) of a magnetic core particle used in the present invention is 15 μm to 80 μm, preferably 20 μm to 60 μm. Since a carrier produced using a magnetic core particle of the above volume based median diameter causes no adhesion among carrier particles, a toner image of high image quality can be stably formed. The volume based median diameters of the magnetic core particle and a carrier can be determined, for example, using laser diffraction particle size distribution meter "HELOS" (produced by Synipatec GmbH) equipped with a wet dispersion device.

The electric resistance of a magnetic core particle used in the present invention is $10^2$ Ω to $10^{12}$ Ω, preferably $10^3$ Ω to $10^{11}$ Ω. A carrier produced using the magnetic core particle having this electric resistance is most suitable for formation of a toner image of high density. Further, since according to the present invention, a resin is inhibited from penetrating pores, no charge leakage due to the presence of pores occurs.

Next, a rubber particle to fill pore apertures of the magnetic core particle surface will be described. As described above, in the present invention, when a resin coated carrier is produced by coating a resin on the magnetic core particle surface, a step is provided in which a rubber particle is filled in pore apertures of a magnetic core particle to form a carrier intermediate. In such a manner, when pore apertures of the magnetic core particle surface is blocked with a rubber particle, in a resin coating step, a melted resin is prevented from penetrating pores and thereafter a coating resin is supplied to carry out resin coating on the magnetic core particle surface. Since rubber exhibits low glass transition temperature and no volume contraction even when applied with pressure, as well as exhibiting solvent resistance even with small cross-linking degree, it is thought that a loss due to excessive penetration of a resin solution into the core particle interior is reduced.

In the present invention, the particle diameter of a rubber particle to fill pore apertures of a magnetic core particle is not specifically limited, being, however, preferably smaller than the pore diameter of a magnetic core particle, for example, preferably 0.3 times to 0.8 times the pore diameter of the magnetic core particle. When the particle diameter of a rubber particle is allowed to be 0.3 times to 0.8 times the pore diameter, pores of the magnetic core particle surface is blocked with the rubber particle or its aggregates, whereby a uniform thin layer with no unevenness on the magnetic core particle surface is formed. Then, the pore apertures are blocked and also a resin particle for resin coating is supplied to the thus-formed smooth magnetic core particle surface with no unevenness. Thereby, it is thought that a smooth resin coated layer with no unevenness is formed, resulting in contribution to production of a carrier exhibiting excellent mobility.

From the viewpoint of enhancing coating efficiency by blocking pore apertures, the content ratio of toluene insoluble matter of a rubber particle is preferably 15% by mass to 95% by mass, more preferably 30% by mass to 70% by mass. Such toluene insoluble matter of a rubber particle can be controlled by the degree of linkage and the selection of a monomer.

Specifically, the content ratio of the toluene insoluble matter of a diene based resin can be controlled using a cross-linking agent acting on a diene based monomer such as butadiene. Specifically, an organic peroxide or sulfur is used. Alternatively, using a divinyl compound such as divinyl benzene, the content ratio of the toluene insoluble matter can also be controlled.

In contrast, in the case of a urethane rubber, controlling is carried out by the density of a urethane bonding group based on a hydrophobic group typified by an alkylene group.

Herein, the mass average molecular weight (Mw) of the toluene insoluble matter is preferably 20,000 to 150,0000, specifically preferably 40,000 to 800,000.

The toluene insoluble matter of a diene based resin can be calculated from the percentage by mass of a residual solid content obtained with respect to a sample in which 3 g of a diene based resin is immersed in 30 ml of toluene for 20 hours and then filtered using a 120-mesh metal mesh.

Further, in the present invention, since a rubber particle enhances the action to block pore apertures of a porous magnetic core particle, the glass transition temperature thereof is preferably in the range of −85° C. to +35° C., more preferably −40° C. to +30° C. When using a rubber particle of this glass transition temperature, pore apertures of a porous magnetic core particle are filled with this rubber particle, the rubber particle is electrostatically aggregated and then pore opening filing is accelerated by the thus-formed aggregates, which is thought to be preferable in production of a carrier of small specific gravity. Further, with this glass transition temperature, when pores of a magnetic core particle is filled, it is thought that a rubber particle exhibits appropriate adhesion performance to carry out efficient filling of pore apertures. In this manner, the selection of glass transition temperature allows aggregation among rubber particles to progress and then rubber particle aggregates having appropriate adhesion performance accelerate pore opening filling, which is thought to be preferable in production of a carrier of small specific gravity.

A rubber particle having the above glass transition temperature can be formed using a resin designing method such as calculation of theoretical glass transition temperature based on the control of molecular weight and the copolymerization ratio of monomers.

Glass transition temperature can be determined by a common method. As a device to determine the glass transition temperature of a rubber particle, for example, in EXAMPLE to be described later, commercially available differential scanning colorimeter DSC 8500 (produced by Perkin Elmer, Inc.) was used. Further, other than the differential scanning colorimeter, for example, available are DSC-7 differential scanning colorimeter (produced by Perkin Elmer, Inc.) and JAC 7/DX thermal analysis instrument controller (produced by Perkin Elmer, Inc.).

Melting point determination using the DSC-7 differential scanning colorimeter is carried out by the following procedure. Initially, 4 mg of a rubber particle is accurately weighed to two places of decimals and then sealed in an aluminum pan (KIT No. 0219-0041) to be set in a DSC-7 sample holder.

Determination conditions are as follows: a determination temperature of 0 to 200° C., a temperature increasing rate of 10° C./minute, and a temperature decreasing rate of 10° C./minute, and under these conditions, heating-cooling-heating temperature controlling is carried out for analysis based on data in the second heating. Herein, as a reference, an empty aluminum pan is used.

The compound constituting the rubber particle is not specifically limited and any compound exhibiting performance as a rubber is usable. A diene based rubber copolymer is preferably used, being specifically listed below. Namely, there are listed acrylic rubber (ACM), nitrile rubber (NBR), isoprene rubber (IR), urethane rubber (UR), ethylene propylene rubber (EPM and EPDM), epichlorohydrin rubber (CO and ECO), chloroprene rubber (CR), styrene butadiene copolymer rubber (SBR), butadiene rubber (BR), fluorine rubber (FKM), and polyisobutylene rubber (IIR).

The production method of a resin coated carrier carried out in the present invention will now be described. In the present invention, via at least following steps of (1) and (2), a resin coated carrier is produced.

Steps (1) and (2) at least carried out in the present invention are described below.

(1) Pore opening blocking step to block pore apertures using a rubber particle by mixing a porous ferrite core material and a rubber particle This step is one in which a rubber particle is filled in pore apertures present on the porous ferrite core particle surface to form a carrier intermediate in which pore apertures present on the core particle surface is capped. Thereby, since only pore apertures are blocked, a rubber particle and a resin coated layer forming resin do not penetrate pores deeply, whereby voids can be formed. Herein, blocking of pore apertures of a porous ferrite core particle by a rubber particle can be carried out using a mixing apparatus used in resin coating on the magnetic core particle surface. In the pore opening blocking step, from the viewpoint of enhancing the degree of blocking, dry mixing is carried out with no coexistence of water or a solvent. Such a mixing apparatus includes, for example, the mixing apparatus shown in FIG. 2.

Figure 2:
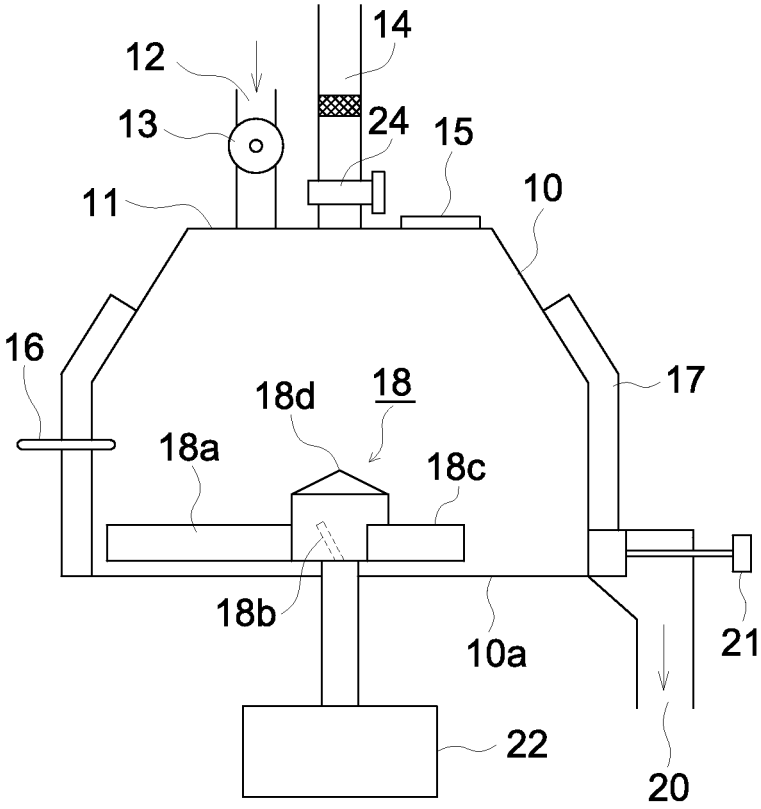
FIG. 2 is a constitution view showing one example a mixing apparatus to produce a carrier intermediate.

The mixing apparatus 1 shown in FIG. 2 has a container main body 10 equivalent to a mixing tank to carry out actual mixing by placing a porous magnetic core particle and a rubber particle therein, in which a thermostatic jacket 17 is arranged in the periphery of the container main body 10 leading up to a height of about three-quarters thereof. The bottom 10*a* of the container main body 10 (referred to also as the "container bottom") is provided with a rotary vane 18 being a stirring member and a carrier intermediate removal opening 20 to remove a produced carrier intermediate, and in the carrier intermediate removal opening 20, a discharge valve 21 is arranged. On top of the container main body 10, a main body upper cover 11 is provided. The main body upper cover 11 is provided with a raw material feed opening 12 in which a feed valve 13 is placed, a filter 14, and an inspection opening 15. Between the filter 14 and the container upper cover 11, a discharge valve 24 is arranged and at the tip of the filter 14, a discharge opening to the container interior is placed.

A porous magnetic core particle and a rubber particle as raw materials for production of a carrier intermediate can be supplied in the container main body 10 interior from the raw material feed opening 12. Herein, the container main body 10 interior to actually produce a carrier intermediate is referred to as a chamber. A thermometer 16 to measure chamber temperature is arranged in the periphery of the container main body 10.

The rotary vane 18 is rotated by a motor 22 being a drive member to stir a core particle and a resin particle. To the central portion 18*d* of the rotary vane 18, stirring vanes 18*a*, 18*b*, and 18*c* are bonded with each angle spacing of 120°. These stirring vanes are attached obliquely with respect to the plane of the bottom 10*a*. When the stirring vanes 18*a*, 18*b*, and 18*c* are rotated at high speed, raw materials such as a porous magnetic core particle and a resin particle are combed up and then collided with the upper inner wall of the main body 10 to fall.

In the mixing apparatus shown in FIG. 2, the operation of the motor 22 to rotate the rotary vane 18 as a stirring member can be controlled, for example, by a control member such as a computer not shown. Namely, the motor 22 is connected to an unshown control member and then on the basis of a program previously memorized in the control member, the operation of the motor 22 is controlled. In such a manner, in the mixing apparatus 1 of FIG. 2, the operation of the motor 22 is controlled by the control member and also the operation of the rotary vane 18 is controlled, whereby the operation of rubber particle filling into pore apertures of a porous magnetic core particle can be carried out.

With regard to rubber particle filling into apertures of a magnetic core particle using the mixing apparatus 1, it is thought that an added rubber particle is aggregated and then aggregates are formed for blocking of pore apertures of the magnetic core particle surface by the aggregates. Rubber particle filling using the mixing apparatus 1 shown in FIG. 2 can be carried out, for example, based on the following procedure. Initially, a porous magnetic core particle and a rubber particle are placed in the container main body 10 and at this moment, cooling water of 10° C. to 15° C. is supplied to the thermostatic jacket 17 to adjust the temperature of the container main body (chamber). Then, in this state, the rotary vane 18 is rotated, for example, at a peripheral velocity of 2 m/s, followed by stiffing/mixing for 1 to 3 minutes, and then the rotary vane 18 is rotated, for example, at a peripheral velocity of 8 m/s for stirring for about 20 minutes. In such a manner, the peripheral velocity of the rotary vane 18 is changed for stirring/mixing and thereby it is thought that via stirring at lower peripheral velocity, on the magnetic core particle surface, aggregation occurs among rubber particles and then via stirring at higher peripheral velocity, the rubber particle aggregates collide with the magnetic core particle surface to block apertures thereof.

(2) Resin coated carrier forming step to form a resin coated layer on a ferrite core particle whose pore apertures have been blocked This step is one in which on the carrier intermediate surface, in which a rubber particle has been filled in pore opening of the porous magnetic core particle surface, a resin is coated to have a resin coated carrier completed.

In the resin coated carrier forming step, for example, as described in EXAMPLE to be described later, a resin coating method via a method referred to as a wet method is preferably employed. Namely, in a film forming method employing the wet method, a resin solution is added to a carrier intermediate and the resultant mixture is mixed, followed by being stirred under a heating environment to coat the carrier intermediate surface with the resin. Stirring in this heating environment is to form a carrier by coating the carrier intermediate surface with a resin and also to carry out heating until the carrier surface becomes smooth by solvent evaporation. As the solvent, from the viewpoint of solubility and drying efficiency, an aromatic solvent such as toluene, xylene, or ethyl benzene, a mixed solvent of an aromatic solvent and methanol, a ketone such as acetone or 2-butanone, ethyl acetate, and tetrahydrofuran are preferably used. Toluene and xylene are specifically preferable.

The concentration of a coating resin is preferably 0.05 to 50% by weight based on the solvent.

Subsequently, after resin coating has been carried out on the carrier intermediated surface, the thus-produced carrier is cooled and thereafter, transferred to a commercially available mixing apparatus to carry out heating in nitrogen ambience for several hours. After heating, sieving treatment is carried out to obtain a resin coated carrier. Via the above steps, using the wet method, a resin coated carrier can be produced.

Figure 1C:
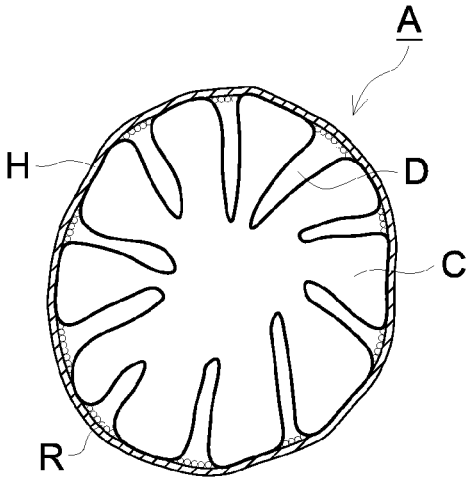
FIG. 1*c* is a schematic view of a carrier particle whose pore apertures have been blocked and the surface has been coated with a rein.

FIG. 1*c* schematically shows a resin coated carrier in which pore apertures R blocked with a rubber particle and a resin coated layer are formed.

Herein, with respect to a carrier intermediate, the thickness of a resin coated layer is preferably 0.3 to 1.2 μm. Specifically, the cross-sections in the vicinity of the center of 10 porous magnetic core particles are photographed using a scanning electron microscope and then photographed images are subjected to image analysis. The average value is designated as porosity. Incidentally, in a porous magnetic core particle used in porosity determination, from a carrier in which a toner has been separated from a developer, a carrier cross-section is prepared using a focused ion beam sample preparation device for observation using a scanning electron microscope. As the focused ion beam sample preparation device, for example, SMI2050 (produced by SII Nano Technology Inc.) is cited. A carrier slice is produced and then the cross-section of the slice is observed using a transmission electron microscope, for example, JEM-2010F (produced by JEOL Ltd) in a view at a magnification of 5000 times and the average value of the maximum film thickness portion and the minimum film thickness portion in this view is determined to be the average thickness of the resin layer. Further, the ratio of a resin to be coated on a carrier intermediate is preferably 0.5 to 4.0% by mass.

Resin coating in production of a resin coated carrier can also be carried out using a mixing apparatus used in carrier intermediate production of FIG. 2 described above other than the wet method. The resin coating method using the mixing apparatus of FIG. 2 in this manner is referred to as a dry method since resin coating is carried out using no resin solution.

As a resin material used for a resin particle supplied in step (2), those used for a resin coated carrier are usable. However, a compound differing from a compound constituting a rubber particle is preferable. Specifically, a vinyl based resin and a condensation resin described below are listed.

Initially, the vinyl based resin includes the following: that is, (1) polyolefin based resins such as, for example, polyethylene, polypropylene, chlorinated polyethylene, or chlorosulfonated polyethylene; (2) polymer resins of vinyl compounds or vinylidene compounds such as, for example, polystyrene, polyacrylate such as polymethyl methacrylate, polyacrylonitrile, polyvinyl acetate, polyvinyl alcohol, polyvinyl butyral, polyvinyl carbazole, polyvinyl ether, or polyvinyl ketone; (3) vinyl based copolymer resins such as, for example, styrene-acrylic acid copolymers; and (4) fluorine resins such as, for example, polytetrafluoroethylene, polyvinyl fluoride, polyvinylidene fluoride, or polychlorofluoroethylene.

Further, the condensation resin includes, for example, a polyurethane resin, a polyester resin, a polyamide resin, a polycarbonate resin, a polyacetal resin, a phenol-formaldehyde resin, a urea-formaldehyde resin, and an epoxy resin.

Still further, usable are a silicone resin having an organic siloxane bond and a modified silicone resin in which a resin such as an alkyd resin or a polyester resin is added to a silicone resin. The modified silicone resin includes, for example, a silicone alkyd resin employing an alkyd resin, a silicone polyester resin employing a polyester resin, a silicone epoxy resin employing an epoxy resin, and a silicone acrylic resin employing an acrylic resin.

Such a resin may coat a carrier entirely, but needs only to coat at least 80%, preferably at least 90% of the surface area of a carrier particle. The thickness of a coated resin is 0.1 to 8 μm, preferably 0.5 to 5 μm. Alternatively, a resin of 5 to 20% by mass of a carrier core particle filled with rubber is used for coating.

Next, a toner used for a two-component developer produced in the present invention will be described. As described above, in a high-speed image forming apparatus, quick print production is demanded. For example, if toner image fixing can be carried out at lower temperatures than conventionally, the reduction of heating time of the fixing device and conveyance speed enhancement of printed matter within the fixing device can be realized. From this point of view, a toner used in a high-speed image forming apparatus is preferably a so-called low temperature fixable one which is melted at lower heating temperatures than conventionally and rapidly solidified even after melted.

In the low temperature fixable toner, to provide the performance of being melted at low heating temperatures and rapidly solidified, relatively low glass transition temperature is set, whereby a problem, in which due to the effect due to stirring in the developing device, adhesion occurs among toner particles, has been noted. Therefore, from the viewpoint of providing durability against heat and impact for a toner, glass transition temperature is required to be set higher to some extent, resulting in an unexpected difficulty in designing a low temperature fixable toner.

Under such a background, with advance of toner production technologies such as a polymerization method, a toner of a core-shell structure has been developed in which a resin area exhibiting low glass transition temperature advantageous for relatively low fixing is coated with a resin exhibiting relatively high glass transition temperature. In this toner, the outer periphery is coated with a hard resin exhibiting durability against heat and mechanical impact, and thereby even when vigorous stirring is carried out in the developing device, problems resulting from breakage due to impact and adhesion among toner particles are overcome. Hence, as described in Patent Document 5, a toner having lower glass transition temperature, for example, 20° C. to 45° C., than the conventional one can be developed. In this manner, a core/shell toner has the compatibility between low temperature fixability and durability against impact, being advantageous in high-speed image formation.

In the present invention, as described above, by making use of the presence of pores, a carrier and a two-component developer in which weight reduction has been realized are produced. Thereby, even with vigorous stirring in the developing device as in high-speed print production, a mechanical impact caused by the carrier is allowed to be smaller than conventionally. Therefore, using a core/shell toner, a two-component developer can be provided in which even when a toner and a carrier continue to be strongly stirred, breakage of toner particles and external additive burial extremely hard to occur and thereby excellent charging performance is expressed over a long term. Further, the developer tends not to induce charging failure and thereby no toner or carrier scattering due to insufficient charging amount occurs and then the problem of fog occurrence and contamination in the machine due to such scattered materials is not produced either.

Next, a production method of a toner used for a two-component developer produced in the present invention will be described. A toner used in the present invention can be produced by a common method. There are cited toner production methods employing a so-called pulverization method in which via kneading, pulverization, and classification steps, toner particles are produced; and a so-called polymerization method in which a polymerizable monomer is polymerized and simultaneously, with controlling of shape and size, particle formation is carried out.

Of these, the toner production method via a polymerization method realizes particle formation with uniform size and shape and therefore is an advantageous method for production of a toner to form high quality images such as dot images and thin line images. In the toner production method employing such a polymerization method, for example, via a step to form a resin particle by polymerization such as suspension polymerization or emulsion polymerization, a toner particle is produced. Of these polymerization methods, the toner production method employing a polymerization method having an association step is specifically preferable in which by polymerization, for example, a resin particle of about 100 nm is produced and then this resin particle is aggregated/fused to produce a toner particle. When this association step is provided, for example, a resin particle exhibiting relatively low glass transition temperature contributing to low fixing is aggregated to produce a particle and then a resin particle exhibiting relatively high glass transition temperature is allowed to adhere and fuse to the surface of the above core particle, whereby a core-shell toner can be produced.

As one example of the toner production method, an emulsion association method, that is, a method, in which a resin particle is produced by emulsion polymerization and via a step to aggregate/fuse the thus-produced resin particle, a toner particle is produced, will now be described. The toner production method employing such an emulsion association method is carried out, for example, via the following steps.

(1) Production step of a resin particle dispersion liquid (2) Aggregation/fusion step (association step) of a resin particle (3) Ripening step (4) Cooling step (5) Washing step (6) Drying step (7) External additive treatment step Each step will now be described.

(1) Production step of a resin particle dispersion liquid

This step is one to form a binder resin constituting a toner particle. Specifically, for example, in a water-based medium, at least a vinyl based polymerizable monomer as described above is added and dispersed, and in this state, the vinyl based polymerizable monomer is polymerized by emulsion polymerization to form resin fine particles of a size of about 100 nm.

In this step, initially, the vinyl based polymerizable monomer is added to a water-based medium, followed by emulsion dispersion treatment to form a water-based medium in which oil droplets of the vinyl based polymerizable monomer is dispersed. Then, in the oil droplets dispersed in the water-based medium, radical polymerization is performed to form resin fine particles.

In this step, it is possible that in addition to a vinyl based polymerizable monomer used for polymerization, toner constituting materials such as wax are added in such a water-based medium and then oil droplets of a polymerizable monomer, in which the toner constituting materials such as wax are dissolved by dispersion, are formed and then radically polymerized. Such oil droplets are radically polymerized and thereby a resin particle containing toner constituting materials such as wax can be formed.

In radical polymerization, a polymerization initiator is caught in oil droplets, and from the polymerization initiator, radicals are generated by the action of heat or light. By these radicals, polymerization of a vinyl based polymerizable monomer is initiated. With advance of polymerization in a chain reaction manner, resin fine particles are formed. Alternatively, available is a method in which radicals having been formed by a polymerization initiator present in a water-based medium are caught in oil droplets and then radical polymerization is initiated to form resin fine particles.

The temperature for radial polymerization depends on the kind of a vinyl based polymerizable monomer and the polymerization initiator to generate radicals, being generally preferably 50° C. to 100° C., more preferably 55° C. to 90° C. Further, polymerization time depends on the vinyl based polymerizable monomer and the reaction rate of radicals, being preferably 2 hours to 12 hours.

In this step, a vinyl based polymerizable monomer is added in a water-based medium and thereafter mechanical energy is applied to the water-based medium for dispersion to form oil droplets of the polymerizable monomer. The dispersion apparatus to form oil droplets of such a polymerizable monomer by applying mechanical energy is not specifically limited, including, for example, commercially available stirring apparatus "CLEARMIX (produced by M Technique Co., Ltd.) equipped with a rotor rotating at high speed as a typical dispersion apparatus. In addition to the stirring apparatus equipped with a rapidly-rotatable rotor, an ultrasonic dispersion apparatus and apparatuses such as a mechanical homogenizer, a Manton-Gaulin homogenizer, and a pressure homogenizer are included. Using any of these dispersion apparatuses, dispersed particles of oil droplets of a size of about 100 nm are formed in a water-based medium.

Herein, a "water-based medium" refers to liquid formed of water and a water soluble organic solvent, containing water at 50% by mass or more. The "water soluble organic solvent" constituting such a water-based medium includes, for example, methanol, ethanol, isopropanol, butanol, acetone, methyl ethyl ketone, and tetrahydrofuran. Of these, an alcohol-based organic solvent such as methanol, ethanol, isopropanol, and butanol exhibiting stability against a rein is preferable.

Since a resin particle constituting a toner particle has molecular weight distribution to some degree, resin fine particles are preferably polymerized in several parts to form a plurality of phases differing in molecular weight distribution. The method to form a resin particle by carrying out polymerization reactions in a stepwise manner is referred to as multi-step polymerization. When multi-step polymerization is carried out, a formed resin particle can be allowed to have, for example, a gradient molecular weight variation toward the particle surface from the particle center. Further, it is possible that initially, a dispersion liquid of a large molecular weight resin particle is prepared and thereafter a polymerizable monomer and a chain transfer agent are newly added to this resin particle dispersion liquid to form a low molecular weight area.

In the case of production of a resin particle, from the viewpoint of production stability and of providing adequate strength for a toner particle to be formed, a multi-step polymerization method such as a two-step polymerization method or a three-step polymerization method is preferably employed. The two-step polymerization method being a typical form of the multi-step polymerization method will now be described.

(Two-Step Polymerization Method)

The two-step polymerization method refers to a method to produce a resin particle having 2 areas, for example, as shown in a resin particle having a central portion formed of a relatively large molecular weight resin and an outer layer formed of a relatively small molecular weight resin. In the two-step polymerization method, polymerization is carried out twice for the first step polymerization and the second step polymerization to form a resin particle.

For example, when a resin particle having different molecular weight distribution is formed, initially, a polymerizable monomer to prepare a large molecular weight resin particle is prepared and added to a water-based medium and thereafter the water-based medium is applied with mechanical energy to form oil droplets of the polymerizable monomer. Then, oil droplets of the polymerizable monomer is polymerized (first step polymerization) as described above to prepare a dispersion liquid of a large molecular weight resin particle.

Subsequently, in the thus-prepared resin particle dispersion liquid, a polymerization initiator and a polymerizable monomer to form a small molecular weight resin are added to polymerize (second step polymerization) the polymerizable monomer in the presence of the large molecular weight resin particle. In this manner, a small molecular weight resin phase is covered on a large molecular weight resin particle surface and thereby a resin particle having a 2 layer structure can be formed.

(2) Aggregation/Fusion Step (Association Step) of a Resin Particle

This step is one in which a resin particle formed in the previous step is aggregated in a water-based medium to form a particle, and then the particle thus-formed by aggregation is heated and fused to form a toner particle, being referred to also as an association step. Namely, this step is one in which a resin particle formed by polymerizing a vinyl base polymerizable monomer via the emulsion polymerization method is aggregated and fused to produce a toner particle.

In this step, in a water-based medium containing a resin particle, an aggregating agent such as an alkali metal salt or an alkaline-earth metal salt typified by magnesium chloride is added to aggregate the resin particle. Subsequently, the water-based medium is heated up to a temperature of at least the glass transition temperature of the resin particle for aggregation promotion and at the same time, for fusion among fused resin particles. Then, with advance of aggregation, when the size of an aggregated particle reaches the targeted one, a salt such as common salt is added to terminate aggregation.

(3) Ripening Step

This step is one in which following the aggregation/fusion step, the reaction system is heated and thereby ripening is carried out until a toner particle is allowed to have a shape of desired average circularity, being referred to also as a shape control step.

(4) Cooling Step

This step is one to cool (to rapidly cool) the above toner particle dispersion liquid. As a cooling condition, at a cooling rate of 1° C./minute to 20° C./minute, cooling is carried out. The cooling method is not specifically limited, and treatment using a cooling method in which a cooling medium is introduced from the outside of the reaction container or a cooling method in which cooling water is directly placed into the reaction system is employable.

(5) Washing Step

This step has a step to carry out solid/liquid separation of a toner particle from the toner particle dispersion liquid having been cooled down to a predetermined temperature in the above step; and a washing step to eliminate adhered materials such as a surfactant and an aggregating agent from the surface of the toner particle having been formed into an aggregate referred to as a wet toner cake via solid/liquid separation.

In washing treatment, water washing is carried out until the electric conductivity of the filtrate reaches, for example, about 10 μS/cm. The solid/liquid separation method includes a centrifugal separation method, a reduced pressure filtration method using a Nutsche funnel, and a filtration method using a filter press.

(6) Drying Step

This step is one to dry the toner particle having been washed. The dryer used in this step includes a spray dryer, a vacuum freeze dryer, and a reduced pressure dryer. A stationary tray dryer, transportable tray dryer, fluid layer dryer, rotary type dryer, or stirring type dryer is preferably used.

The moisture in the dried toner particle is preferably at most 5% by mass, more preferably at most 2% by mass. Incidentally, when aggregation occurs among the dried toner particles via weak interparticle attractive force, the aggregates may be pulverized. Herein, as the pulverizing apparatus, a mechanical pulverizing apparatus such as a jet mill, a HENSCHEL mixer, a coffee mill, or a food processor may be used.

Via the above steps leading to the drying step, a toner particle is formed.

(7) External Additive Treatment Step

This step is one in which external additives and lubricants are added to a toner particle having been obtained by drying. The toner particle having been obtained via the drying step may be used for image formation as obtained. However, external additive addition makes it possible to further enhance the chargeability and mobility of a toner, as well as cleaning properties. As these external additives, inorganic fine particles, organic fine particles, and aliphatic metal salts are usable. The added amount thereof is 0.1 to 10.0% by mass, preferably 0.5 to 4.0% by mass based on the entire toner. Further, as external additives, various types thereof can be added in combination. Incidentally, a mixing apparatus used in addition of external additives includes, for example, mechanical mixing apparatuses such as a tabular mixer, a HENSCHEL mixer, a Nauta mixer, a V-type mixer, and a coffee mixer As described above, the toner production method via the emulsion association method makes it possible to produce a toner particle with adjustment of the structure, particle diameter, and shape of the particle.

Further, a toner used in the present invention contains toner constituting materials such as binder resins, colorants, waxes, and external additives, for which those well-known can be used. As specific examples of these resins, colorants, waxes, and external additives, those described in the section "Toner Constituting Materials" of JP-A No. 2009-25600 are cited.

EXAMPLE

With reference to an example, the preferred embodiment of the present invention will now specifically he described that by no means limits the scope of the present invention. Herein, the following description contains portions described by "parts," representing "parts by mass."

1. Production of "Resin Coated Carriers 1 to 15"

Via the following procedure, "resin coated carriers 1 to 15" in which the magnetic core particle surface was coated with a resin were produced.

1-1. Production of "Ferrite Core Particles 1 to 6"

(1) Production of "Ferrite Core Particles 1"

A manganese/magnesium/strontium ferrite core particle having the following molar ratio of each metal oxide was produced.

| | |
|---|---|
| MnO | 35 mole % |
| MgO | 14.5 mole % |
| $Fe_2O_3$ | 50 mole % |
| SrO | 0.5 mole % |

Initially, with respect to the $Fe_2O_3$, trimanganese tetraoxide as a raw material of the MnO, magnesium hydroxide as a raw material of the MgO, and strontium carbonate as a raw material of the SrO, each raw material was weighed so that the constituent molar ratios of a produced material became the above values. Each weighed raw material was placed in a commercially available dry media mill (a vibration mill; stainless steel beads of a diameter of ⅛ inch (1 inch=2.54 cm) were used) and pulverized for 5 hours to allow a pulverized material to be formed into a pellet of about 1 square mm using "Roller Compactor (produced by Turbo Kogyo Co., Ltd.)."

Subsequently, the produced pellet was passed through a sieve of a mesh opening of 3 mm for coarse powder elimination and then through a sieve of a mesh opening of 0.5 mm for fine powder elimination, followed by tentative firing by heating at 1050° C. for 3 hours using a commercially available rotary electric furnace. After tentative firing, using the above dry media mill, pulverization was carried out until the average particle diameter reached 4.1 μm, followed by water addition and 5-hour pulverization using a commercially available wet media mill (a vertical beads mill; stainless steel beads of a diameter of 1/16 inch were used) to produce a slurry. The primary particle diameter of the pulverized material in the thus-produced slurry was determined to be 1.8 μm based on D50, using dynamic light scattering particle size distribution analyzer "MICROTRACK UPA150 (produced by Microtrack Inc.).

An appropriate amount of a commercially available dispersion agent was added to the slurry and then a 20% by mass aqueous solution of polyvinyl alcohol (PVA) was added at 0.4% by mass based on the solid content, followed by granulation and drying using a commercially available spray dryer to produce a granulated material. Particle size adjustment of the thus-produced granulated material was carried out by a well-known method, followed by 2-hour heating at 700° C. using the rotary electric furnace to eliminate organic materials such as the dispersion agent and polyvinyl alcohol.

Then, using a commercially available tunnel-type electric furnace, 5-hour maintenance was carried out at a firing temperature of 1150° C. under nitrogen ambience. In this ease, temperature increasing rate and cooling rate were set at 150° C./hour and 110° C./hour, respectively. After the above firing treatment, pulverization was carried out and further classification was performed for particle size adjustment, followed by separation of low magnetization products using a commercially available magnetic separator to produce porous "ferrite core particle 1" of a volume based median diameter (D50) of 35 μm. The peak pore diameter and the pore diameter variation dv of thus-produced "ferrite core particle 1" were 1.26 μm and 0.58, respectively.

(2) Production of "Ferrite Core Particle 2"

In production of above "ferrite core particle 1," firing using the tunnel-type electric furnace was carried out at a firing temperature of 1,050° C. in the atmosphere for 2.5 hours and thereafter the firing was changed to one under the following conditions: a firing temperature of 1180° C., an ambience of nitrogen gas, and 2.5-hour treatment). Via the same procedure except the above conditions, porous "ferrite core particle 2" was produced. The peak pore diameter and the pore diameter variation dv of thus-produced "ferrite core particle 2" were 0.8 μm and 0.93, respectively.

(3) Production of "Ferrite Core Particle 3"

In production of above "ferrite core particle 1," the pulverization performed after the above tentative firing was carried out with stainless steel beads of a ⅛ inch diameter for 1 hour using a commercially available wet ball mill, and thereafter this pulverization was changed to 12-hour pulverization with stainless steel beads of a 1/16 inch diameter. In this manner, the slurry, in which the primary particle diameter (D50) of a pulverized material was 1 μm, was produced. Further, the firing using the tunnel-type electric furnace was changed to one in which hydrogen gas was introduced into the furnace to create a reducing ambience and the firing temperature was 850° C. with 1-hour maintenance. Via the same procedure except the above conditions, porous "ferrite core particle 3" was produced. The peak pore diameter and the pore diameter variation dv of thus-produced "ferrite core particle 3" were 0.21 μm and 0.20, respectively.

(4) Production of "Ferrite Core Particle 4"

In production of above "ferrite core particle 1," the pulverization performed after the tentative firing was changed to 0.5-hour pulverization carried out with stainless steel beads of a ⅛ inch diameter using a commercially available wet ball mill. Further, the firing temperature in use of the tunnel-type electric furnace was changed to 1100° C. Via the same procedure except the above conditions, porous "ferrite core particle 4" was produced. The peak pore diameter and the pore diameter variation dv of thus-produced "ferrite core particle 4" were 1.78 μm and 1.22, respectively.

(5) Production of "Ferrite Core Particle 5"

In production of above "ferrite core particle 3," in the pulverization performed after the tentative firing, pulverization with stainless steel beads of a 1/16 inch diameter was changed to one carried out for 15 hours. In this manner, the slurry, in which the primary particle diameter (D50) of a pulverized material was of 1 μm, was produced. Via the same procedure as for "ferrite core particle 3" except the above condition, porous "ferrite core particle 5" was produced. The peak pore diameter and the pore diameter variation dv of thus-produced "ferrite core particle 5" were 0.18 μm and 0.15, respectively.

(6) Production of "Ferrite Core Particle 6"

In production of above "ferrite core particle 1," using a batch-type electric furnace instead of the tunnel-type electric furnace, the firing was changed to one carried out at a firing temperature of 1100° C. under nitrogen gas ambience with 3-hour maintenance. After 3-hour maintenance, in the same manner as for "ferrite core particle 1," pulverization was carried out and further classification was performed for particle size adjustment, followed by separation of low magnetization products using a commercially available magnetic separator to produce porous "ferrite core particle 6." The peak pore diameter and the pore diameter variation dv of thus-produced "ferrite core particle 6" were 1.91 μm and 1.39, respectively.

The peak pore diameters and the pore diameter variations dv of "ferrite core particles 1 to 6" produced via the above procedures are shown in Table 1.

TABLE 1

| Ferrite Core Particle No. | Peak Fine Pore Diameter (μm) | Fine Pore Diameter Variation | Porosity |
|---|---|---|---|
| 1 | 1.26 | 0.58 | 32% |
| 2 | 0.80 | 0.93 | 28% |
| 3 | 0.21 | 0.20 | 25% |
| 4 | 1.78 | 1.22 | 36% |
| 5 | 0.18 | 0.15 | 19% |
| 6 | 1.91 | 1.39 | 42% |

1-2. Production of "Rubber Particles 1 to 8"

(1) Production of "Rubber Particle 1"

A pressure-resistant container was charged, as polymerizable monomers, with the following.

| | |
|---|---|
| Butadiene | 25 parts by mass |
| Styrene | 65 parts by mass |
| Methyl methacrylate | 8 parts by mass, |
| Acrylic acid | 2 parts by mass |

Further, the following was placed therein.

| | |
|---|---|
| Ion exchange water | 200 parts by mass |
| t-Dodecyl mercaptan | 1 part by mass |
| Dodecylbenzene sulfonic acid | 0.1 parts by mass |
| Potassium peroxide | 1 part by mass. |

Then, under nitrogen ambience, 2-hour polymerization was carried out at 70° C., and further the reaction was continued for 3 hours for polymerization completion to produce a latex in which "rubber particle 1" was dispersed. The glass transition temperature and the volume based median diameter of thus-produced "rubber particle 1" were determined by a method to be described later.

Then, the latex of above "rubber particle 1" was freeze-dried to obtain "rubber particle 1."

(2) Production of "Rubber Particle 2"

"Rubber particle 2" was produced in the same manner as in production of "rubber particle 1" except that the polymerizable monomers used in production of "rubber particle 1" were changed to the following.

| | |
|---|---|
| Butadiene | 98 parts by mass |
| Acrylic acid | 2 parts by mass |

(3) Production of "Rubber Particle 3"

"Rubber particle 3" was produced in the same manner as in production of "rubber particle 1" except that the polymerizable monomers used in production of "rubber particle 1" were changed to the following.

| | |
|---|---|
| Isoprene | 98 parts by mass |
| Acrylic acid | 2 parts by mass |

(4) Production of "Rubber Particle 4"

"Rubber particle 4" was produced in the same manner as in production of "rubber particle 1" except that the polymerizable monomers used in production of "rubber particle 1" were changed to the following:

| | |
|---|---|
| Butadiene | 59 parts by mass |
| Acrylonitrile | 34 parts by mass |
| n-Monobutyl maleate | 7 parts by mass |

and the following was placed.

| | |
|---|---|
| Ion exchange water | 200 parts by mass |
| Cumene hydroperoxide | 1 part by mass |

(5) Production of "Rubber Particle 5"

The following compounds were placed in methyl ethyl ketone.

| | |
|---|---|
| 4,4'-Diphenylmethane diisocyanate | 282 by mass |
| Bisphenol A propylene oxide 3-mole adduct | 1,000 parts by mass |

"Then, urethanization was carried out at 80° C. for 6 hours and unreacted isocyanate was treated with methanol, followed by solvent removal to obtain 1,270 parts of a polyurethane resin.

Subsequently, using mechanical dispersion apparatus "CLEAMIX (produced by M Technique Co., Ltd.)" equipped with a circular path, the following was mixed and dispersed for 50 minutes to prepare an aqueous dispersion liquid of a polyurethane resin.

| | |
|---|---|
| The above polyurethane resin | 400 parts by mass |
| Sodium polyoxyethylene (2) lauryl ether sulfate (effective component: 27%) | 20 parts by mass |
| Ion exchange water | 1,580 parts by mass |

The aqueous dispersion liquid of this polyurethane resin was freeze-dried to produce "rubber particle 5."

(6) Production of "Rubber Particle 6"

"Rubber particle 6" was produced in the same manner as in production of "rubber particle 5" except that the duration of mixing/dispersion by mechanical dispersion apparatus "CLEAMIX (produced by M Technique Co., Ltd.)" was changed to 15 minutes.

(7) Production of "Rubber Particle 7"

"Rubber particle 7" was produced in the same manner as in production of "rubber particle 5" except that the duration of mixing/dispersion by mechanical dispersion apparatus "CLEAMIX (produced by M Technique Co., Ltd.)" was changed to 30 minutes.

(8) Production of "Rubber Particle 8"

"Rubber particle 8" was produced in the same manner as in production of "rubber particle 5" except that the duration of mixing/dispersion by mechanical dispersion apparatus "CLEAMIX (produced by M Technique Co., Ltd.)" was changed to 90 minutes.

(9) Glass Transition Temperature Determination of "Rubber Particles 1 to 8"

Glass transition temperature determination of above "rubber particles 1 to 8" was carried out based on a procedure described below. Namely, a dispersion liquid of each "rubber particle" produced by the above procedure was freeze-dried. Then, 4.5 mg of the thus-dried sample was weighed to 2 places of decimals. Subsequently, the weighed sample was sealed in an aluminum pan and set in the sample holder of commercially available differential scanning calorimeter "DSC8500 (produced by Perkin Elmer, Inc.).

In determination, at a determination temperature range of −120° C. to +100° C., a temperature increasing rate of 10° C./minute, and a temperature decreasing rate of 10° C./minute, heating-cooling-heating temperature controlling was carried out, and analysis was conducted based on data in the 2nd heating. For the reference, an empty aluminum pan was used. The glass transition temperature based on the above determination was designated as the value of the intersection of the extension of the base line, prior to the rise of the first endothermic peak, with the tangent showing the maximum inclination between the initial rise of the first endothermic peak and the peak summit.

(10) Determination of the Glass Transition Temperature of "Rubber Particles 1 to 8"

The glass transition temperature of each of "rubber particles 1 to 8" was determined based on the following procedure. Namely, several drops of a dispersion liquid of each "rubber particle" produced by the above procedure were dripped into a 50-ml measuring cylinder and 25 ml of pure water was added, followed by dispersion of 3 minutes using ultrasonic washing machine "US-1 (produced by As One Corp.)" to produce a measurement sample. Three ml of this measurement sample was placed in "MICROTRACK UPA-150 (produced by Nikkiso Co., Ltd.)" and then the Sample Loading value was confirmed to be in the range 0.1 to 100 to carry out measurement under the following conditions.

Measurement conditions

| | |
|---|---|
| Transparency | Yes |
| Refractive Index | 1.59 |
| Particle Density | 1.05 g/cm$^3$ |
| Spherical Particle | Yes |

Solvent conditions

| | |
|---|---|
| Refractive Index | 1.33 |

Viscosity

High (temp): $0.797\times10^{-3}$ Pa·S

Low (temp.): $1.002\times10^{-3}$ Pa·S

The constituent material, the volume based median diameter, the glass transition temperature of each of "rubber particles 1 to 8" are shown in Table 2.

TABLE 2

| Rubber Particle No. | Rubber Particle Material | Volume Based Median Diameter (μm) | Glass Transition Temperature (° C.) |
|---|---|---|---|
| 1 | SBR | 0.25 | 30 |
| 2 | butadiene rubber | 0.27 | −85 |
| 3 | isoprene rubber | 0.30 | −75 |
| 4 | nitrile rubber | 0.27 | −45 |
| 5 | urethane rubber | 0.30 | 30 |
| 6 | urethane rubber | 0.80 | 30 |
| 7 | urethane rubber | 0.45 | 30 |
| 8 | urethane rubber | 0.15 | 30 |

1-3. Production of "Resin Coated Carriers 1 to 15"

(1) Production of "Resin Coated Carrier 1"

<Pore Opening Blocking Step>

A mixing apparatus equipped with a stirring vane was charged with 100 parts by mass of above "ferrite core particle 2" and 0.5 part by mass of above "rubber particle 1" and then the resultant mixture was mixed at a peripheral velocity of 1 m/s for 2 minutes, followed by stirring/mixing of 20 minutes at a peripheral velocity of 8 m/s to form a ferrite core particle whose pore apertures were blocked (hereinafter referred to as a carrier intermediate). In a series of the mixing treatment, dry mixing was carried out with no coexistence of liquid such as water or a solvent.

<Resin Coated Carrier Forming Step>

Subsequently, via the following procedure, a coating resin solution was produced. Namely, commercially available silicone resin "SR2410 (produced by Dow Corning Toray Co., Ltd.) was diluted with 200 parts by mass of toluene so as for the silicone resin solid content to be at 10% by mass, and thereafter γ-aminopropyltrimethoxysilane was added at 8 parts by mass based on the silicone resin, followed by mixing well.

The carrier intermediate and the coating resin solution were placed in a mixing/stirring machine (produced by Fuji Paudal Co., Ltd.) and then with depressurization, nitrogen gas was introduced, followed by heating up to 65° C. and stirring to coat the carrier intermediate surface with the resin. To realize a resin coating amount of 2.5 parts by mass, the coating resin solution was introduced in plural parts and then stirring was carried out at the above heating temperature until the carrier became smooth by solvent elimination.

After the above coating, a formed carrier was cooled, and after cooled, the carrier was transferred to a JURIER mixer (produced by Tokuju Corp.) and heated under nitrogen ambience at 160° C. for 2 hours. After heating, vibration sieving was carried out using a mesh of a mesh opening of 105 μm to produce "resin coated carrier 1."

(2) Production of "Resin Coated Carriers 2 to 8 and 15"

"Resin coated carrier 2 to 8" were produced in the same manner as in production of "resin coated carrier 1" except that instead of "rubber particle 1," "rubber particles 2 to 8" each were used for carrier intermediate formation. Further, in production of "resin coated carrier 1," without production of a carrier intermediate using "rubber particle 1," "magnetic core particle 2" was directly subjected to resin coating using the coating resin solution to produce "resin coated carrier 15."

(3) Production of "Resin Coated Carrier 9"

In production of above "resin coated carrier 1," instead of "ferrite core particle 2" and "rubber particle 1," "ferrite core particle 1" and "rubber particle 6" were used, respectively to produce a carrier intermediate. Via the same procedure as in production of "resin coated carrier 1" except the above, "resin coated carrier 9" was produced.

(4) Production of "Resin Coated Carrier 10"

In production of"resin coated carrier 1," instead of"ferrite core particle 2" and "rubber particle 1," "ferrite core particle 3" and "rubber particle 8" were used, respectively to produce a carrier intermediate. Via the same procedure as in production of "resin coated carrier 1" except the above, "resin coated carrier 10" was produced.

(5) Production of "Resin Coated Carriers 11 and 13"

"Resin coated carrier 11" was produced in the same manner as in production of "resin coated carrier 9" except that instead of "ferrite core particle 1," "ferrite core particle 4" was used to form a caner intermediate. Further, "resin coated carrier 13" was produced in the same manner as in production of "resin coated carrier 9" except that instead of "ferrite core particle 1," "ferrite core particle 6" was used to form a carrier intermediate.

(6) Production of "Resin Coated Carrier 12"

"Resin coated carrier 12" was produced in the same manner as in production of "resin coated carrier 10" except that instead of "ferrite core particle 3," "ferrite core particle 5" was used to form a carrier intermediate.

(7) Production of "Resin Coated Carrier 14"

A mixing apparatus equipped with a stirring vane was charged with 100 parts by mass of above "ferrite core particle 2" and 0.5 part by mass of above "rubber particle 5" and the resultant mixture was mixed at a peripheral velocity of 1 m/s for 2 minutes, followed by stirring/mixing of 20 minutes at a peripheral velocity of 8 m/s to form a carrier intermediate. After formation of the carrier intermediate, the mixing apparatus equipped with a stirring vane was charged with 2.5 parts by mass of above commercially available silicone resin "SR2410 (produced by Dow Corning Toray Co., Ltd.) to be mixed at a peripheral velocity of 8 m/s for 40 minutes. After the above stirring/mixing treatment, using a mesh of a mesh opening of 105 μm, vibration sieving was carried out to produce "resin coated carrier 14" via a dry method.

With regard to "resin coated carriers 1 to 15" produced via the above procedures, the numbers of the ferrite core particles used for production and the pore diameters (μm) thereof, the numbers of the rubber particles and the volume based median diameters thereof, and the ratios of the volume based median diameters of the rubber particles to the pore diameters are shown in Table 3.

TABLE 3

| | Ferrite Core Particle | | Rubber Particle | | Ratio (Particle |
|---|---|---|---|---|---|
| Resin Coated Carrier No. | No. | Fine Pore Diameter (μm) | No. | Particle Diameter (μm) | Diameter/ Fine Pore Diameter) |
| 1 | 2 | 0.80 | 1 | 0.25 | 0.31 |
| 2 | 2 | 0.80 | 2 | 0.27 | 0.34 |
| 3 | 2 | 0.80 | 3 | 0.30 | 0.38 |
| 4 | 2 | 0.80 | 4 | 027 | 0.92 |
| 5 | 2 | 0.80 | 5 | 0.30 | 0.38 |
| 6 | 2 | 0.80 | 6 | 0.80 | 1.00 |
| 7 | 2 | 0.80 | 7 | 0.45 | 0.56 |
| 8 | 2 | 0.80 | 8 | 0.15 | 0.19 |
| 9 | 1 | 1.26 | 6 | 0.80 | 0.63 |
| 10 | 3 | 0.21 | 8 | 0.15 | 0.71 |
| 11 | 4 | 1.78 | 6 | 0.80 | 0.45 |
| 12 | 5 | 0.18 | 8 | 0.15 | 0.83 |
| 13 | 6 | 1.91 | 6 | 0.80 | 0.42 |
| 14 | 2 | 0.80 | 5 | 0.30 | 0.38 |
| 15 | 2 | 0.80 | — | — | — |

2. Toner Production

Via the following procedure, a core/shell toner was produced.

(Production of a Core Resin Particle)

(1) First Step Polymerization

A reaction container fitted with a stirrer, a thermal sensor, a condenser tube, and a nitrogen introducing device was charged with the following compounds and mixed to produce a mixed liquid.

| | |
|---|---|
| Styrene | 111 parts by mass |
| n-Butyl alcohol | 53 parts by mass |
| Methacrylic acid | 12 parts by mass |

To the above mixed liquid, the following was added.

| | |
|---|---|
| Paraffin wax "HNP-57" (produced by Nippon Seiro Co., Ltd.) | 94 parts by mass |

Thereafter, the temperature was raised up to 80° C. for dissolution to prepare a polymerizable monomer solution.

On the other hand, a surfactant solution was prepared in which 3 parts by mass of sodium polyoxyethylene (2) dodecyl ether sulfate was dissolved in 1340 parts by mass of ion exchange water. This surfactant solution was heated up to 80° C. and therein, the above polymerizable monomer solution was added. Then, the polymerizable monomer solution was mixed/dispersed for 2 hours using mechanical dispersion apparatus "CLEAMIX (produced by M Technique Co., Ltd.)" equipped with a circular path to prepare an emulsified particle (oil droplet) dispersion liquid of an average particle diameter of 245 nm.

Subsequently, 1460 parts by mass of ion exchange water was added to the above dispersion liquid, and then an initiator solution in which 6 parts by mass of potassium persulfate was dissolved in 142 parts by mass of ion exchange water and 1.8 parts by mass of n-octyl mercaptan were added, followed by temperature elevation up to 80° C. This system was stirred with heating at 80° C. for 3 hours for polymerization (first step polymerization) to produce "resin particle C."

(2) Second Step Polymerization (Outer Layer Formation)

In a dispersion liquid of above "resin particle C," an initiator solution in which 5.1 parts by mass of potassium persulfate was dissolved in 197 parts by mass of ion exchange water was added, and then under a temperature condition of 80° C., a monomer liquid mixture in which compounds listed below were mixed was dripped over 1 hour. The monomer liquid mixture contained the following.

| | |
|---|---|
| Styrene | 282 parts by mass |
| n-Butyl acrylate | 134 parts by mass |
| Methacrylic acid | 31 parts by mass |
| n-Octyl mercaptan | 5 parts by mass |

After termination of dripping of the monomer liquid mixture, heating/stirring was carried out for 2 hours for polymerization (second step polymerization). Thereafter, cooling was carried out down to 28° C. to produce a "core resin particle." The weight average molecular weight, mass average particle diameter, and glass transition temperature (Tg) of the "core resin particle" were 21300, 180 nm, and 39° C., respectively.

(Production of a Shell Resin Particle)

In a reaction container fitted with a stirrer, a thermal sensor, a condenser tube, and a nitrogen introducing device, a surfactant solution was prepared in which 2 parts by mass of sodium polyoxyethylene (2) dodecyl ether sulfate was dissolved in 3000 parts by mass of ion exchange water, and then with stirring under nitrogen stream at a stirring rate of 230 rpm, the inner temperature was raised up to 80° C.

In the surfactant solution, an initiator solution in which 10 parts by mass of potassium persulfate was dissolved in 200 parts by mass of ion exchange water was added, and then a polymerizable monomer liquid mixture in which compounds listed below were mixed was dripped over 3 hours. Herein, the polymerizable monomer liquid mixture contained the following.

| | |
|---|---|
| Styrene | 528 parts by mass |
| n-Butyl acrylate | 176 parts by mass |
| Methacrylic acid | 120 parts by mass |
| n-Octyl mercaptan | 22 parts by mass |

After termination of dripping of the polymerizable monomer liquid mixture, the temperature of this system was raised up to 80° C. and stirred with heating for 1 hour for polymerization to produce a "shell resin particle." The weight average molecular weight, mass average particle diameter, and glass transition temperature (Tg) of the "shell resin particle" were 12000, 120 nm, and 53° C., respectively.

(Production of a Colorant Dispersion Liquid)

While 900 parts by mass of a 10% by mass aqueous solution of sodium dodecylsulfate was stirred, 100 parts by mass of commercially available carbon black "REGAL 330R (produced by Cabot Corp.)" was gradually added thereto, followed by being dispersed using stirring apparatus "CLEARMIX" (produced by M Technique Co., Ltd.) to prepare a colorant dispersion liquid. The average dispersion diameter of colorant particles in the colorant dispersion liquid was determined to be 150 μm, using commercially available dynamic light scattering particle size distribution analyzer "MICROTRACK UPA150 (produced by Microtrack Inc.).

(Production of a Toner Particle)

(1) Aggregation/Fusion Step

A reaction container fitted with a thermal sensor, a condenser tube, and a nitrogen introducing device, and a stirrer was charged with the following to be stirred.

| | |
|---|---|
| Core resin particle | 421 parts by mass (in terms of the solid content) |
| Ion-exchange water | 900 parts by mass |
| Colorant dispersion liquid | 200 parts by mass (in terms of the solid content) |

The temperature in the container was adjusted at 30° C. and then a 5 mole/liter aqueous solution of sodium hydroxide was added to adjust pH to 9.

Subsequently, an aqueous solution in which 2 parts by mass of magnesium chloride-hexahydrate was dissolved in 1000 parts by mass of ion exchange water was added at 30° C. over 10 minutes with stirring. Further, after the resultant system was allowed to stand for 3 minutes, temperature elevation was initiated and then the temperature of this system was raised up to 65° over 60 minutes. In this state, the particle diameter of aggregated particles was determined using "COULTER MULTISIZER 3 (produced by Beckman Coulter, Inc.)." When volume based median diameter (D50) reached 5.5 μm, an aqueous solution in which 40 parts by mass of sodium chloride was dissolved in 1000 parts by mass of ion exchange water was added to terminate particle diameter growth. Further, as ripening treatment, at a liquid temperature of 70° C., heating/stirring was carried out for 1 hour to continue fusion to form a "core portion." The average circularity of the "core portion" was determined to be 0.930, using "FPIA2100 (produced by Sysmex Corp.).

(2) Shell Formation

Subsequently, at 65° C., 50 parts by mass (in terms of the solid content) of the "shell resin particle" was added and then an aqueous solution in which 2 parts by mass of magnesium chloride-hexahydrate was dissolved in 1000 parts by mass of ion exchange water was added over 10 minutes. After addition, temperature elevation was carried out up to 70° C. (shell formation temperature) and stirring was continued for 1 hour and thereby the "shell resin particle" was fused to the "core portion" surface. Thereafter, an aqueous solution in which 40 parts by mass of sodium chloride was dissolved in 1000 parts by mass of ion exchange water was added to terminate shell formation. Further, ripening was carried out at 75° C. for 20 minutes and then cooling was performed at a rate of 8° C./minute down to 30° C. to produce a toner particle dispersion liquid.

(Washing/Drying Step)

The toner particle dispersion liquid produced via the above steps was subjected to solid/liquid separation using basket-type centrifuge "MARK III Type No. 60×40 (produced by Matsumoto Kikai Mfg. Co., Ltd.)" to form a wet cake of a colored particle. This wet cake was washed with ion exchanged water using the above basket type centrifuge until the electric conductivity of the filtrate reached 5 μS/cm, followed by being transferred to "FLASH JET DRYER" (produced by Seishin Enterprise Co., Ltd.), and drying was carried out until the water content reached 0.5% by mass to produce a "colored particle." The toner particle produced via the above procedure has a core/shell structure. The volume based median diameter and glass transition temperature thereof were 6.0 μm and 9.5° C., respectively.

(External Additive Treatment of Toner)

Hydrophobic silica fine particles of a number average primary particle diameter of 80 nm and hydrophobic titania fine particles of a number average primary particle diameter of 10 nm were added to 100 parts by mass of the thus-produced "toner particle" at 3.5% by mass and 0.6% by mass, respectively. Then, using "HENSCHEL MIXER" (produced by Mitsui Miike Engineering Co., Ltd.), mixing was carried out at a peripheral velocity of 35 m/s for 25 seconds to produce a toner. Herein, the produced toner had the same glass transition temperature of 39.5° C. as the toner particle before treated with the external additives.

3. Production of "Developers 1 to 15"

Above "resin coated carriers 1 to 15" and the above "toner" were blended in the following manner to produce two-component "developers 1 to 15," respectively. Developer production was carried out at a blending ratio of 8 parts by mass of the toner to 100 parts by mass of each carrier under normal temperature and humidity (temperature: 20° C., relative humidity: 50% RH) in which using a V blender, the toner and the carrier were mixed. The number of rotations of the V blender and stirring duration were set to be 20 rpm and 20 minutes, respectively, for the above treatment. Further, the thus-mixed material was sieved using a mesh of a mesh opening of 125 μm for production.

4. Evaluation Experiments

Above "developers 1 to 15" were successively mounted in commercially available digital color multifunction peripheral bizhub PRO C6500 (produced by Konica Minolta Business Technologies, Inc.) to produce prints for evaluation. As described later, evaluation items were transfer rate and carder adhesion with respect to printed matter produced at a predetermined number of sheets, as well as a toner and carrier scattering state at the termination of print production. Ranks A and B in each item were evaluated to be acceptable.

In print production, continuous printing of 200000 sheets was carried out for each developer under normal temperature and humidity of a temperature of 20° C. and a relative humidity of 50% RH. The printed image had a pixel ratio of 1% with a character image, a human face photographic image, a solid white image, and a solid black image of a pixel ratio of 7%, and as an image support, high-quality paper (64 g/m$^2$) of A4 size was used.

Herein, evaluations conducted using "developers 1 to 14" each having a carrier produced by the production method having the constitution of the present invention correspond to "Examples 1 to 14" and evaluations conducted using "developer 15" containing a carrier produced by the production method having no constitution of the present invention correspond to "Comparative Example 1."

<Evaluation of Transfer Rate>

At initiation and termination of continuous printing, a solid image (20 mm×50 mm) of an image density of 1.30 was produced and then using the following expression, transfer rate was calculated for evaluation, as follows.

Transfer rate (%)=(mass of toner transferred on the image support/mass of toner developed on the photoreceptor)×100

(Evaluation Criteria)

A: Transfer rate is at least 95%, being excellent

B: Transfer rate is 90% to less than 95%, being non-problematic

C: Transfer rate is 80% to less than 90%, being practically non-problematic

D: Transfer rate is less than 80%, being practically problematic

<Carrier Adhesion on an Image>

After termination of continuous printing of 200000 sheets, a solid image was output over the entire image support and then the thus-output solid image was visually observed using a magnifying lens of a magnification of 10 times for counting adhered carrier particles to evaluate carrier adhesion, as follows.

(Evaluation Criteria)

A: No carrier adhesion on the solid image is noted.

B: The number of carrier adhesion spots on the solid image is at most 5, being practically non-problematic.

C: The number of carrier adhesion spots on the solid image is at most 10, being practically non-problematic.

D: The number of carrier adhesion spots on the solid image is more than 10, being practically problematic.

<Toner and Carrier Scattering State=

After termination of continuous printing of 200000 sheets, the periphery of the developing device was visually observed to evaluate the contamination state in the machine due to toner and carrier scattering, as follows.

(Evaluation Criteria)

A: No in-machine contamination due to toner and carrier scattering is noted.

B: In-machine contamination due to minor toner and carrier scattering is slightly noted, which is manageable with no vacuum cleaner during maintenance, being practically non-problematic.

C: In-machine contamination due to minor toner and carrier scattering is slightly noted, which is manageable with a vacuum cleaner during maintenance, being practically non-problematic.

D: In-machine contamination due to toner and carrier scattering is markedly noted, which necessitates use of a vacuum cleaner and hand washing after operations during maintenance, being practically problematic.

The above evaluation results are shown in Table 4.

TABLE 4

| | Resin | Transferability | | | Toner and |
|---|---|---|---|---|---|
| | Coated Carrier No. | At Initiation | At Termination | Carrier Adhesion State | Carrier Scattering State |
| Example 1 | 1 | A | A | A | A |
| Example 2 | 2 | A | A | A | A |
| Example 3 | 3 | A | A | A | A |
| Example 4 | 4 | A | A | A | A |
| Example 5 | 5 | A | A | A | A |
| Example 6 | 6 | A | B | B | C |
| Example 7 | 7 | A | A | A | A |
| Example 8 | 8 | A | C | B | C |
| Example 9 | 9 | A | A | A | A |
| Example 10 | 10 | A | A | A | A |
| Example 11 | 11 | A | A | A | A |
| Example 12 | 12 | A | C | B | B |
| Example 13 | 13 | A | B | C | C |
| Example 14 | 14 | A | A | A | A |
| Comparative Example 1 | 15 | A | C | D | D |

As shown in Table 4, in each of "Examples 1 to 14" in which a developer containing a carrier produced by the production method having the constitution according to the present invention, excellent transfer rate was maintained even after continuous printing of 200000 sheets and no carrier adhesion on the solid image was noted. Further, nearly no contamination in the developing device periphery due to toner and carrier scattering after continuous printing of 200000 sheets was noted.

These results confirmed that in "Examples 1 to 14," the developer was not degraded even when applied with the impact due to stirring in the developing device, and thereby the carrier exhibited stable charge providing performance and contributed to excellent print production. On the other hand, "Comparative Example 1" using a developer having a carrier produced by the production method having no constitution according to the present invention confirmed that no results as obtained in "Examples 1 to 14" were obtained.

The invention claimed is:

1. A production method of a two-component developer for developing an electrostatic image comprising a toner and a resin coated carrier having a porous magnetic core particle and a resin coated layer, wherein the porous magnetic core particle is composed of a porous ferrite material having pore apertures on a surface of the particle, wherein the method comprises steps of;

blocking the pore apertures of the porous magnetic core particle with rubber particles by dry mixing of the porous magnetic core particle and the rubber particles, forming the resin coated carrier by forming a resin layer on the porous magnetic core particle whose pore apertures have been blocked, and mixing the resin coated carrier and the toner.

2. The method of claim 1, wherein the pore apertures of the porous magnetic core particle have a diameter 0.2 μm to 1.8 μm, and the particle diameter of each of the rubber particles is 0.3 times to 0.8 times of the diameter of the pore apertures.

3. The method of claim 1, wherein glass transition temperature of the rubber particles is −85° C. to +35° C.

4. The method of claim 1, wherein glass transition temperature of the rubber particles is −40° C. to +30° C.

5. The method of claim 1, wherein a content of toluene insoluble matter of the rubber particles is 15% by mass to 95% by mass.

6. The method of claim 1, wherein a content of toluene insoluble matter of the rubber particles is 30% by mass to 70% by mass.

7. The method of claim 1, wherein a ratio occupied by space areas formed by pores in the porous magnetic core particle is 20% to 40%.

8. The method of claim 1, wherein the ferrite material comprises manganese, magnesium, strontium, calcium, titanium, lithium, aluminum, silicon, zirconium or bismuth.

9. The method of claim 1, wherein the ferrite material has a density of 3.0 g/cm$^3$ to 5.5 g/cm$^3$.

10. The method of claim 7, wherein the ferrite material has a density of 4.0 g/cm$^3$ to 5.5 g/cm$^3$.

* * * * *